US010199044B2

(12) United States Patent
Vasilache et al.

(10) Patent No.: US 10,199,044 B2
(45) **Date of Patent: *Feb. 5, 2019**

(54) AUDIO SIGNAL ENCODER COMPRISING A MULTI-CHANNEL PARAMETER SELECTOR

(71) Applicant: Nokia Technologies Oy, Espoo (FI)

(72) Inventors: Adriana Vasilache, Tampere (FI); Lasse Juhani Laaksonen, Tampere (FI); Anssi Sakari Rämö, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/777,222

(22) PCT Filed: Mar. 20, 2013

(86) PCT No.: PCT/IB2013/052203

§ 371 (c)(1),
(2) Date: Sep. 15, 2015

(87) PCT Pub. No.: WO2014/147441

PCT Pub. Date: Sep. 25, 2014

(65) Prior Publication Data

US 2016/0035357 A1 Feb. 4, 2016

(51) Int. Cl.

| | |
|---|---|
| ***G10L 19/008*** | (2013.01) |
| ***G10L 19/002*** | (2013.01) |
| ***H04S 3/00*** | (2006.01) |

(52) U.S. Cl.

CPC ..... *G10L 19/008* (2013.01); *G10L 19/002* (2013.01); *H04S 3/008* (2013.01); *H04S 2400/01* (2013.01); *H04S 2420/03* (2013.01)

(58) Field of Classification Search
None
See application file for complete search history.

(56) References Cited

U.S. PATENT DOCUMENTS

2003/0026490 A1* 2/2003 Thyagarajan ..... H04N 19/176 382/244
2005/0195981 A1 9/2005 Faller et al.
(Continued)

FOREIGN PATENT DOCUMENTS

WO 2009048239 4/2009
WO 2011/029984 A1 3/2011
(Continued)

OTHER PUBLICATIONS

International Search Report and Written Opinion received for corresponding Patent Cooperation Treaty Application No. PCT/IB2013/052203, dated Feb. 25, 2014, 12 pages.
(Continued)

*Primary Examiner* — Curtis A Kuntz
*Assistant Examiner* — Qin Zhu
(74) *Attorney, Agent, or Firm* — Alston & Bird LLP

(57) ABSTRACT

An apparatus comprising: a channel analyzer configured to determine for a first frame of at least one audio signal a set of first frame audio signal multi-channel parameters; a multichannel parameter selector configured to select for the first frame a sub-set of the set of first frame audio signal multi-channel parameters based on a value associated with the first frame; and a multichannel parameter encoder configured to generate an encoded first frame audio signal multi-channel parameter based on the selected sub-set of the set of first frame audio signal multi-channel parameters.

14 Claims, 10 Drawing Sheets

(56) References Cited

U.S. PATENT DOCUMENTS

| | | | | |
|---|---|---|---|---|
| 2005/0226426 | A1* | 10/2005 | Oomen | G10L 19/008 381/23 |
| 2008/0086302 | A1* | 4/2008 | Krishnan | G10L 19/005 704/225 |
| 2009/0210234 | A1* | 8/2009 | Sung | G10L 19/18 704/500 |
| 2010/0324708 | A1* | 12/2010 | Ojanpera | G10L 19/008 700/94 |
| 2011/0046945 | A1* | 2/2011 | Li | G10L 19/008 704/201 |
| 2012/0173247 | A1* | 7/2012 | Sung | G10L 19/002 704/500 |
| 2012/0207311 | A1 | 8/2012 | Hoang et al. | |
| 2012/0265523 | A1* | 10/2012 | Greer | G10L 19/24 704/201 |
| 2013/0132099 | A1* | 5/2013 | Oshikiri | G10L 19/008 704/500 |

FOREIGN PATENT DOCUMENTS

| | | | |
|---|---|---|---|
| WO | 2013/179084 | A1 | 12/2013 |
| WO | 2014/013294 | A1 | 1/2014 |
| WO | 2014/108738 | A1 | 7/2014 |

OTHER PUBLICATIONS

Extended European Search Report received for corresponding European Patent Application No. 13878647.0, dated Oct. 11, 2016, 8 pages.

* cited by examiner

AUDIO SIGNAL ENCODER COMPRISING A MULTI-CHANNEL PARAMETER SELECTOR

RELATED APPLICATION

This application was originally filed as PCT Application No. PCT/IB2013/052203 filed Mar. 20, 2013.

FIELD

The present application relates to a multichannel or stereo audio signal encoder, and in particular, but not exclusively to a multichannel or stereo audio signal encoder for use in portable apparatus.

BACKGROUND

Audio signals, like speech or music, are encoded for example to enable efficient transmission or storage of the audio signals.

Audio encoders and decoders (also known as codecs) are used to represent audio based signals, such as music and ambient sounds (which in speech coding terms can be called background noise). These types of coders typically do not utilise a speech model for the coding process, rather they use processes for representing all types of audio signals, including speech. Speech encoders and decoders (codecs) can be considered to be audio codecs which are optimised for speech signals, and can operate at either a fixed or variable bit rate.

An audio codec can also be configured to operate with varying bit rates. At lower bit rates, such an audio coder may be optimized to work with speech signals at a coding rate equivalent to a pure speech codec. At higher bit rates, the audio codec may code any signal including music, background noise and speech, with higher quality and performance. A variable-rate audio codec can also implement an embedded scalable coding structure and bitstream, where additional bits (a specific amount of bits is often referred to as a layer) improve the coding upon lower rates, and where the bitstream of a higher rate may be truncated to obtain the bitstream of a lower rate coding. Such an audio codec may utilize a codec designed purely for speech signals as the core layer or lowest bit rate coding.

An audio codec is designed to maintain a high (perceptual) quality while improving the compression ratio. Thus instead of waveform matching coding it is common to employ various parametric schemes to lower the bit rate. For multichannel audio, such as stereo signals, it is common to use a larger amount of the available bit rate on a mono channel representation and encode the stereo or multichannel information exploiting a parametric approach which uses relatively fewer bits.

SUMMARY

There is provided according to a first aspect a method comprising: determining for a first frame of at least one audio signal a set of first frame audio signal multi-channel parameters; selecting for the first frame a sub-set of the set of first frame audio signal multi-channel parameters based on a value associated with the first frame; and generating an encoded first frame audio signal multi-channel parameter based on the selected sub-set of the set of first frame audio signal multi-channel parameters.

The method may further comprise determining a coding bitrate for the first frame of at least one audio signal; and wherein selecting for the first frame a sub-set of the set of first frame audio signal multi-channel parameters based on a value associated with the first frame comprises selecting the sub-set of the set of first frame audio signal multi-channel parameters further based on the coding bitrate for the first frame of the at least one audio signal.

Determining for a first frame of at least one audio signal a set of first frame audio signal multi-channel parameters may comprise determining a set of differences between at least two channels of the at least one audio signal, wherein the set of differences comprises two or more difference values, where each difference value is associated with a sub-division of resources defining the first frame.

Determining a set of differences between at least two channels of the at least one audio signal may comprise determining at least one of: at least one interaural time difference; and at least one interaural level difference.

The sub-division of resources defining the first frame may comprise at least one of: sub-band frequencies; and time periods.

Selecting for the first frame a sub-set of the set of first frame audio signal multi-channel parameters based on a value associated with the first frame may comprise: determining a previous frame selected sub-set final element; determining a number of elements to be selected; and selecting the number of elements to be selected starting from an element succeeding the previous frame selected sub-set final element.

Selecting for the first frame a sub-set of the set of first frame audio signal multi-channel parameters based on a value associated with the first frame may comprise: generating a sub-set element index by mapping the value associated with the first frame to the set of first frame audio signal multi-channel parameters; determining a number of elements to be selected; and selecting the number of elements to be selected starting from the sub-set element index.

Selecting the number of elements may comprise at least one of: selecting successive elements, and when reaching the last element in the set the next element to be selected is the first element in the set; and selecting elements according to a determined selection pattern, wherein the determined selection pattern comprises selecting elements from the set separated by a number of elements.

Generating an encoded first frame audio signal multi-channel parameter based on the selected subset of the set of first frame audio signal multi-channel parameters may comprise generating codebook indices for groups of the at least one first frame audio signal multichannel parameter using vector or scalar quantization codebooks.

Generating codebook indices for groups of the at least one first frame audio signal multi-channel parameter using vector or scalar quantization codebooks may comprise: generating a first encoding mapping with an associated index for the at least one first frame audio signal multi-channel parameter dependent on a frequency distribution of mapping instances of the at least one first frame audio signal multi-channel parameter; and encoding the first encoding mapping dependent on the associated index.

Encoding the first encoding mapping dependent on the associated index comprises may apply a Golomb-Rice encoding to the first encoding mapping dependent on the associated index.

The method may further comprise: receiving at least two audio signal channels; determining a fewer number of channels audio signal from the at least two audio signal channels and the at least one first frame audio signal multi-channel parameter; generating an encoded audio signal comprising the fewer number of channels; combining the encoded audio signal and the encoded at least one first frame audio signal multi-channel parameter.

According to a second aspect there is provided a method comprising: receiving within a first period a encoded audio signal comprising at least one first frame downmix audio signal and at least one multi-channel audio signal parameter signal comprising a sub-set of a set of first frame audio signal multi-channel parameters; recovering any elements of the set of audio signal multi-channel parameters not present in the sub-set of first frame audio signal multi-channel parameters; and generating for the frame at least two channel audio signals from the at least one first frame downmix audio signal and the combination of the a sub-set of a set of first frame audio signal multi-channel parameters and recovered elements of the set of audio signal multi-channel parameters not present in the sub-set of first frame audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a third aspect there is provided an apparatus comprising: means for determining for a first frame of at least one audio signal a set of first frame audio signal multi-channel parameters; means for selecting for the first frame a sub-set of the set of first frame audio signal multi-channel parameters based on a value associated with the first frame; and means for generating an encoded first frame audio signal multi-channel parameter based on the selected sub-set of the set of first frame audio signal multi-channel parameters.

The apparatus may further comprise means for determining a coding bitrate for the first frame of at least one audio signal; and wherein the means for selecting for the first frame a sub-set of the set of first frame audio signal multi-channel parameters based on a value associated with the first frame may comprise means for selecting the sub-set of the set of first frame audio signal multi-channel parameters further based on the coding bitrate for the first frame of the at least one audio signal.

The means for determining for a first frame of at least one audio signal a set of first frame audio signal multi-channel parameters may comprise means for determining a set of differences between at least two channels of the at least one audio signal, wherein the set of differences comprises two or more difference values, where each difference value is associated with a sub-division of resources defining the first frame.

The means for determining a set of differences between at least two channels of the at least one audio signal may comprise at least one of: means for determining at least one interaural time difference; and means for determining at least one interaural level difference.

The sub-division of resources defining the first frame may comprise at least one of: sub-band frequencies; and time periods.

The means for selecting for the first frame a sub-set of the set of first frame audio signal multi-channel parameters based on a value associated with the first frame may comprise: means for determining a previous frame selected sub-set final element; means for determining a number of elements to be selected; and means for selecting the number of elements to be selected starting from an element succeeding the previous frame selected sub-set final element.

The means for selecting for the first frame a sub-set of the set of first frame audio signal multi-channel parameters based on a value associated with the first frame may comprise: means for generating a sub-set element index by mapping the value associated with the first frame to the set of first frame audio signal multi-channel parameters; means for determining a number of elements to be selected; and means for selecting the number of elements to be selected starting from the sub-set element index.

The means for selecting the number of elements may comprise at least one of: means for selecting successive elements, and when reaching the last element in the set the next element to be selected is the first element in the set; and means for selecting elements according to a determined selection pattern, wherein the determined selection pattern comprises selecting elements from the set separated by a number of elements.

The means for generating an encoded first frame audio signal multi-channel parameter based on the selected sub-set of the set of first frame audio signal multi-channel parameters may comprise means for generating codebook indices for groups of the at least one first frame audio signal multi-channel parameter using vector or scalar quantization codebooks.

The means for generating codebook indices for groups of the at least one first frame audio signal multi-channel parameter using vector or scalar quantization codebooks may comprise: means for generating a first encoding mapping with an associated index for the at least one first frame audio signal multi-channel parameter dependent on a frequency distribution of mapping instances of the at least one first frame audio signal multi-channel parameter; and means for encoding the first encoding mapping dependent on the associated index.

The means for encoding the first encoding mapping dependent on the associated index may comprise means for applying a Golomb-Rice encoding to the first encoding mapping dependent on the associated index.

The apparatus may further comprise: means for receiving at least two audio signal channels; means for determining a fewer number of channels audio signal from the at least two audio signal channels and the at least one first frame audio signal multi-channel parameter; means for generating an encoded audio signal comprising the fewer number of channels; and means for combining the encoded audio signal and the encoded at least one first frame audio signal multi-channel parameter.

According to a fourth aspect there is provided an apparatus comprising: means for receiving within a first period a encoded audio signal comprising at least one first frame downmix audio signal and at least one multi-channel audio signal parameter signal comprising a sub-set of a set of first frame audio signal multi-channel parameters; means for recovering any elements of the set of audio signal multi-channel parameters not present in the sub-set of first frame audio signal multi-channel parameters; and means for generating for the frame at least two channel audio signals from the at least one first frame downmix audio signal and the combination of the a sub-set of a set of first frame audio signal multi-channel parameters and recovered elements of the set of audio signal multi-channel parameters not present in the sub-set of first frame audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a fifth aspect there is provided an apparatus comprising at least one processor and at least one memory including computer program code for one or more programs, the at least one memory and the computer program code configured to, with the at least one processor, cause the apparatus at least to: determine for a first frame of at least one audio signal a set of first frame audio signal multi-channel parameters; select for the first frame a sub-set of the set of first frame audio signal multi-channel parameters based on a value associated with the first frame; and generate an encoded first frame audio signal multi-channel parameter based on the selected sub-set of the set of first frame audio signal multi-channel parameters.

The apparatus may further be caused to determine a coding bitrate for the first frame of at least one audio signal; and wherein selecting for the first frame a sub-set of the set of first frame audio signal multi-channel parameters based on a value associated with the first frame may cause the apparatus to select the sub-set of the set of first frame audio signal multi-channel parameters further based on the coding bitrate for the first frame of the at least one audio signal.

Determining for a first frame of at least one audio signal a set of first frame audio signal multi-channel parameters may cause the apparatus to determine a set of differences between at least two channels of the at least one audio signal, wherein the set of differences comprises two or more difference values, where each difference value is associated with a sub-division of resources defining the first frame.

Determining a set of differences between at least two channels of the at least one audio signal may cause the apparatus to perform at least one of: determine at least one interaural time difference; and determine at least one interaural level difference.

The sub-division of resources defining the first frame may comprise at least one of: sub-band frequencies; and time periods.

Selecting for the first frame a sub-set of the set of first frame audio signal multi-channel parameters based on a value associated with the first frame may cause the apparatus to: determine a previous frame selected sub-set final element; determine a number of elements to be selected; and select the number of elements to be selected starting from an element succeeding the previous frame selected sub-set final element.

Selecting for the first frame a sub-set of the set of first frame audio signal multi-channel parameters based on a value associated with the first frame may cause the apparatus to: generate a sub-set element index by mapping the value associated with the first frame to the set of first frame audio signal multi-channel parameters; determine a number of elements to be selected; and select the number of elements to be selected starting from the sub-set element index.

Selecting the number of elements may cause the apparatus to perform at least one of: select successive elements, and when reaching the last element in the set the next element to be selected is the first element in the set; and select elements according to a determined selection pattern, wherein the determined selection pattern may cause the apparatus to select elements from the set separated by a number of elements.

Generating an encoded first frame audio signal multi-channel parameter based on the selected sub-set of the set of first frame audio signal multi-channel parameters may cause the apparatus to generate codebook indices for groups of the at least one first frame audio signal multi-channel parameter using vector or scalar quantization codebooks.

Generating codebook indices for groups of the at least one first frame audio signal multi-channel parameter using vector or scalar quantization codebooks may cause the apparatus to: generate a first encoding mapping with an associated index for the at least one first frame audio signal multi-channel parameter dependent on a frequency distribution of mapping instances of the at least one first frame audio signal multi-channel parameter; and encode the first encoding mapping dependent on the associated index.

Encoding the first encoding mapping dependent on the associated index may cause the apparatus to apply a Golomb-Rice encoding to the first encoding mapping dependent on the associated index.

The apparatus may further be caused to: receive at least two audio signal channels; determine a fewer number of channels audio signal from the at least two audio signal channels and the at least one first frame audio signal multi-channel parameter; generate an encoded audio signal comprising the fewer number of channels; and combine the encoded audio signal and the encoded at least one first frame audio signal multi-channel parameter.

According to a sixth aspect there is provided an apparatus comprising at least one processor and at least one memory including computer program code for one or more programs, the at least one memory and the computer program code configured to, with the at least one processor, cause the apparatus at least to: receive within a first period a encoded audio signal comprising at least one first frame downmix audio signal and at least one multi-channel audio signal parameter signal comprising a sub-set of a set of first frame audio signal multichannel parameters; recover any elements of the set of audio signal multi-channel parameters not present in the subset of first frame audio signal multi-channel parameters; and generate for the frame at least two channel audio signals from the at least one first frame downmix audio signal and the combination of the a sub-set of a set of first frame audio signal multi-channel parameters and recovered elements of the set of audio signal multi-channel parameters not present in the sub-set of first frame audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

According to a seventh aspect there is provided an apparatus comprising: a channel analyser configured to determine for a first frame of at least one audio signal a set of first frame audio signal multichannel parameters; a multichannel parameter selector configured to select for the first frame a sub-set of the set of first frame audio signal multi-channel parameters based on a value associated with the first frame; and a multichannel parameter encoder configured to generate an encoded first frame audio signal multi-channel parameter based on the selected sub-set of the set of first frame audio signal multi-channel parameters.

The apparatus may further comprise a bitrate determiner configured to determine a coding bitrate for the first frame of at least one audio signal; and wherein the multichannel parameter selector may be configured to select the sub-set of the set of first frame audio signal multi-channel parameters further based on the coding bitrate for the first frame of the at least one audio signal.

The channel analyser may comprise a difference determiner configured to determine a set of differences between at least two channels of the at least one audio signal, wherein the set of differences comprises two or more difference values, where each difference value is associated with a sub-division of resources defining the first frame.

The difference determiner may comprise at least one of: a shift difference determiner configured to determine at least one interaural time difference; and a level difference determiner configured to determine at least one interaural level difference.

The sub-division of resources defining the first frame may comprise at least one of: sub-band frequencies; and time periods.

The multichannel parameter selector may be configured to: determine a previous frame selected sub-set final element; determine a number of elements to be selected; and select the number of elements to be selected starting from an element succeeding the previous frame selected sub-set final element.

The multichannel parameter selector may be configured to: generate a sub-set element index by mapping the value associated with the first frame to the set of first frame audio signal multi-channel parameters; determine a number of elements to be selected; and select the number of elements to be selected starting from the sub-set element index.

The multichannel parameter selector may be configured to: select successive elements, and when reaching the last element in the set the next element to be selected is the first element in the set.

The multichannel parameter selector may be configured to select elements according to a determined selection pattern, wherein the determined selection pattern may cause the apparatus to select elements from the set separated by a number of elements.

The multichannel parameter encoder may be configured to generate codebook indices for groups of the at least one first frame audio signal multi-channel parameter using vector or scalar quantization codebooks.

The multichannel parameter encoder may be configured to: generate a first encoding mapping with an associated index for the at least one first frame audio signal mum-channel parameter dependent on a frequency distribution of mapping instances of the at least one first frame audio signal mufti-channel parameter; and encode the first encoding mapping dependent on the associated index.

The multichannel parameter encoder may be configured to apply a Golomb-Rice encoding to the first encoding mapping dependent on the associated index.

The apparatus may further comprise: an input configured to receive at least two audio signal channels; a downmixer configured to determine a fewer number of channels audio signal from the at least two audio signal channels and the at least one first frame audio signal multi-channel parameter; a downmixed channel encoder configured to generate an encoded audio signal comprising the fewer number of channels; and multiplexer configured to combine the encoded audio signal and the encoded at least one first frame audio signal multi-channel parameter.

According to an eighth aspect there is provided an apparatus comprising: an input configured to receive within a first period a encoded audio signal comprising at least one first frame downmix audio signal and at least one multi-channel audio signal parameter signal comprising a sub-set of a set of first frame audio signal multi-channel parameters; a parameter set compiler configured to recover any elements of the set of audio signal multi-channel parameters not present in the sub-set of first frame audio signal multi-channel parameters; and a multichannel generator configured to generate for the frame at least two channel audio signals from the at least one first frame downmix audio signal and the combination of the a sub-set of a set of first frame audio signal multi-channel parameters and recovered elements of the set of audio signal multi-channel parameters not present in the sub-set of first frame audio signal multi-channel parameters.

The set of first frame audio signal multi-channel parameters may comprise a set of differences between at least two channels of at least one audio signal, wherein the set of differences comprises two or more difference values, where each difference value is associated with a sub-division of resources defining the first frame.

The set of differences between at least two channels of the at least one audio signal may comprise at least one of: at least one interaural time difference; and at least one interaural level difference.

The sub-division of resources defining the first frame may comprise at least one of: sub-band frequencies; and time periods.

A computer program product may cause an apparatus to perform the method as described herein.

An electronic device may comprise apparatus as described herein.

A chipset may comprise apparatus as described herein.

BRIEF DESCRIPTION OF DRAWINGS

For better understanding of the present invention, reference will now be made by way of example to the accompanying drawings in which.

DESCRIPTION OF SOME EMBODIMENTS OF THE APPLICATION

The following describes in more detail possible stereo and multichannel speech and audio codecs, including layered or scalable variable rate speech and audio codecs. However current low bit rate binaural extension layers produce a poor quality decoded binaural signal. This is caused by lack of resolution in the quantization of the binaural parameters (delays and level differences) or by the fact that not all subbands are represented by their corresponding binaural parameter in the encoded bitstream. This is because conventional bitrate constraints for the binaural extension has led to the quantization resolution of the parameters to be decreased (and therefore allowing fewer representation levels) or not all of the subbands are represented by a corresponding parameter. Furthermore typical level differences parameters are coded starting from the higher subbands downwards, for as many subbands as there are bits available thus generating binaural extensions which typically do not generate lower frequency representations.

The concept for the embodiments as described herein is to attempt to generate a stereo or multichannel audio coding that produces efficient high quality and low bit rate stereo (or multichannel) signal coding.

The concept for the embodiments as described herein is thus to generate a coding scheme such that given a number of bits available for the binaural extension for a first frame the channel differences (such as level differences) are encoded starting with the subband denoted by "first" subband until a "last" subband (for example a sequentially downwards or upwards progression). The subsequent frames then generate a binaural extension by encoding the channel differences starting from the subband after the "last" subband and continuing the progression. This continues frame by frame until all of the subbands have been encoded and then the sequence of selecting subbands to encode start again.

Thus for example supposing that there are enough bits to code downwards only 5 subband level parameters, the variable "first" will be updated to "first-5" for the next frame.

The differences that do not get encoded with the available amount of bits, can use at the decoding the values they had at the previous frame. Therefore only part of the level difference parameters will be coded, circularly across the frequency bands.

Figure 1:
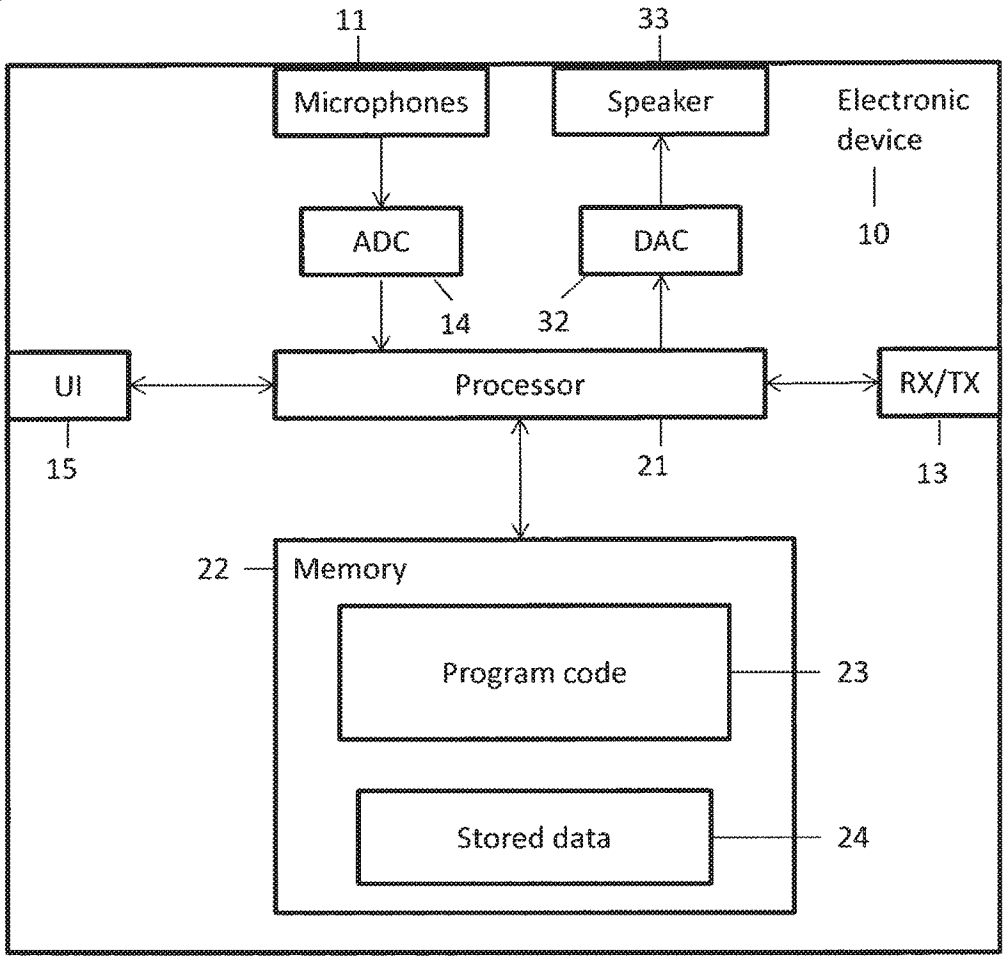
FIG. 1 shows schematically an electronic device employing some embodiments.

In this regard reference is first made to FIG. 1 which shows a schematic block diagram of an exemplary electronic device or apparatus 10, which may incorporate a codec according to an embodiment of the application.

The apparatus 10 may for example be a mobile terminal or user equipment of a wireless communication system. In other embodiments the apparatus 10 may be an audio-video device such as video camera, a Television (TV) receiver, audio recorder or audio player such as a mp3 recorder/player, a media recorder (also known as a mp4 recorder/player), or any computer suitable for the processing of audio signals.

The electronic device or apparatus 10 in some embodiments comprises a microphone 11, which is linked via an analogue-to-digital converter (ADC) 14 to a processor 21. The processor 21 is further linked via a digital-to-analogue (DAC) converter 32 to loudspeakers 33. The processor 21 is further linked to a transceiver (RX/TX) 13, to a user interface (UI) 15 and to a memory 22.

The processor 21 can in some embodiments be configured to execute various program codes. The implemented program codes in some embodiments comprise a multichannel or stereo encoding or decoding code as described herein. The implemented program codes 23 can in some embodiments be stored for example in the memory 22 for retrieval by the processor 21 whenever needed. The memory 22 could further provide a section 24 for storing data, for example data that has been encoded in accordance with the application.

The encoding and decoding code in embodiments can be implemented in hardware and/or firmware.

The user interface 15 enables a user to input commands to the electronic device 10, for example via a keypad, and/or to obtain information from the electronic device 10, for example via a display. In some embodiments a touch screen may provide both input and output functions for the user interface. The apparatus 10 in some embodiments comprises a transceiver 13 suitable for enabling communication with other apparatus, for example via a wireless communication network.

It is to be understood again that the structure of the apparatus 10 could be supplemented and varied in many ways.

A user of the apparatus 10 for example can use the microphones 11, or array of microphones, for inputting speech or other audio signals that are to be transmitted to some other apparatus or that are to be stored in the data section 24 of the memory 22. A corresponding application in some embodiments can be activated to this end by the user via the user interface 15. This application in these embodiments can be performed by the processor 21, causes the processor 21 to execute the encoding code stored in the memory 22.

The analogue-to-digital converter (ADC) 14 in some embodiments converts the input analogue audio signal into a digital audio signal and provides the digital audio signal to the processor 21. In some embodiments the microphone 11 can comprise an integrated microphone and ADC function and provide digital audio signals directly to the processor for processing.

Figure 8:
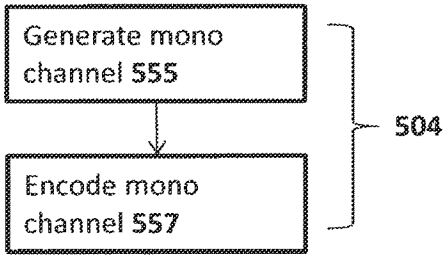
FIG. 8 shows a flow diagram illustrating the operation of the mono parameter encoder as shown in FIG. 4 according to some embodiments.
Figure 9:
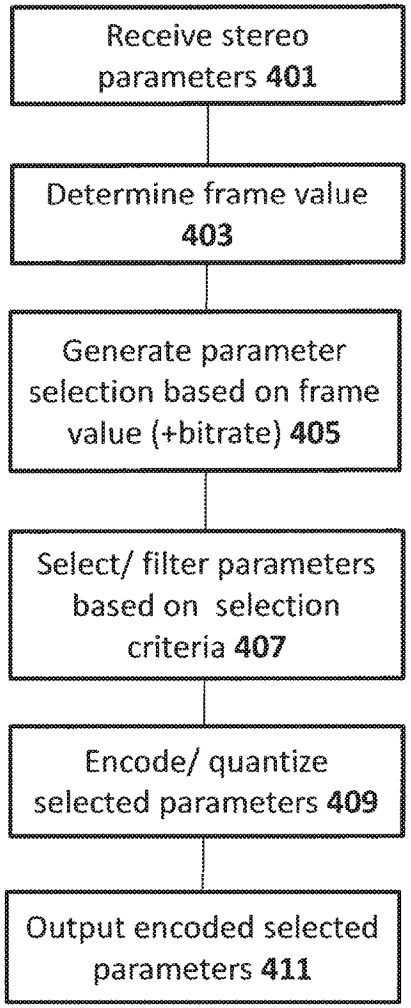
FIG. 9 shows a flow diagram illustrating the operation of the stereo parameter encoder as shown in FIG. 5 according to some embodiments.
Figure 10:
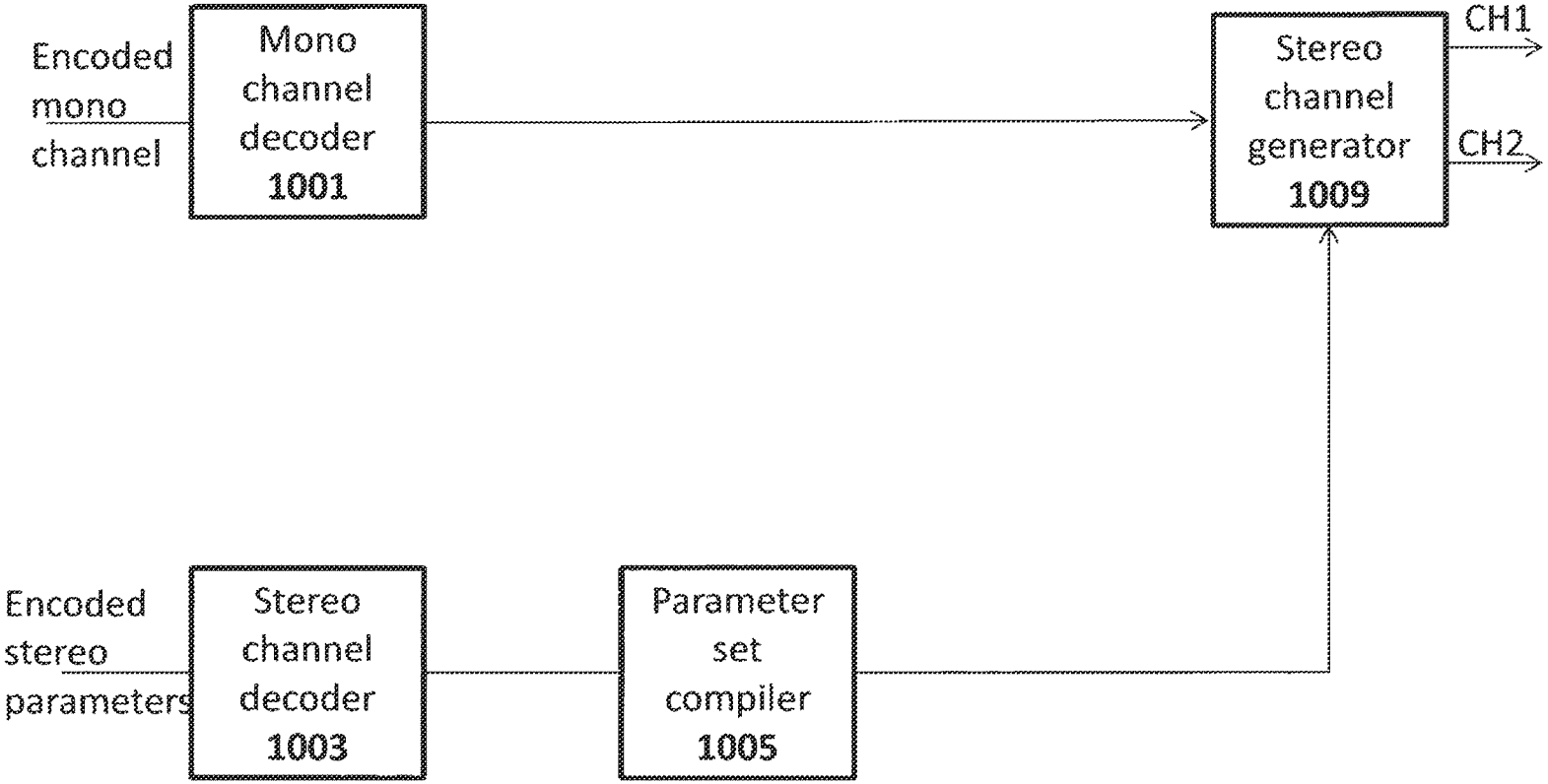
FIG. 10 shows schematically a decoder as shown in FIG. 2 according to some embodiments.

The processor 21 in such embodiments then processes the digital audio signal in the same way as described with reference to the system shown in FIG. 2, the encoder shown in FIGS. 3 to 8 and the decoder as shown in FIGS. 9 and 10.

The resulting bit stream can in some embodiments be provided to the transceiver 13 for transmission to another apparatus. Alternatively, the coded audio data in some embodiments can be stored in the data section 24 of the memory 22, for instance for a later transmission or for a later presentation by the same apparatus 10.

The apparatus 10 in some embodiments can also receive a bit stream with correspondingly encoded data from another apparatus via the transceiver 13. In this example, the processor 21 may execute the decoding program code stored in the memory 22. The processor 21 in such embodiments decodes the received data, and provides the decoded data to a digital-to-analogue converter 32. The digital-to-analogue converter 32 converts the digital decoded data into analogue audio data and can in some embodiments output the analogue audio via the loudspeakers 33. Execution of the decoding program code in some embodiments can be triggered as well by an application called by the user via the user interface 15.

The received encoded data in some embodiment can also be stored instead of an immediate presentation via the loudspeakers 33 in the data section 24 of the memory 22, for instance for later decoding and presentation or decoding and forwarding to still another apparatus.

Figure 4:
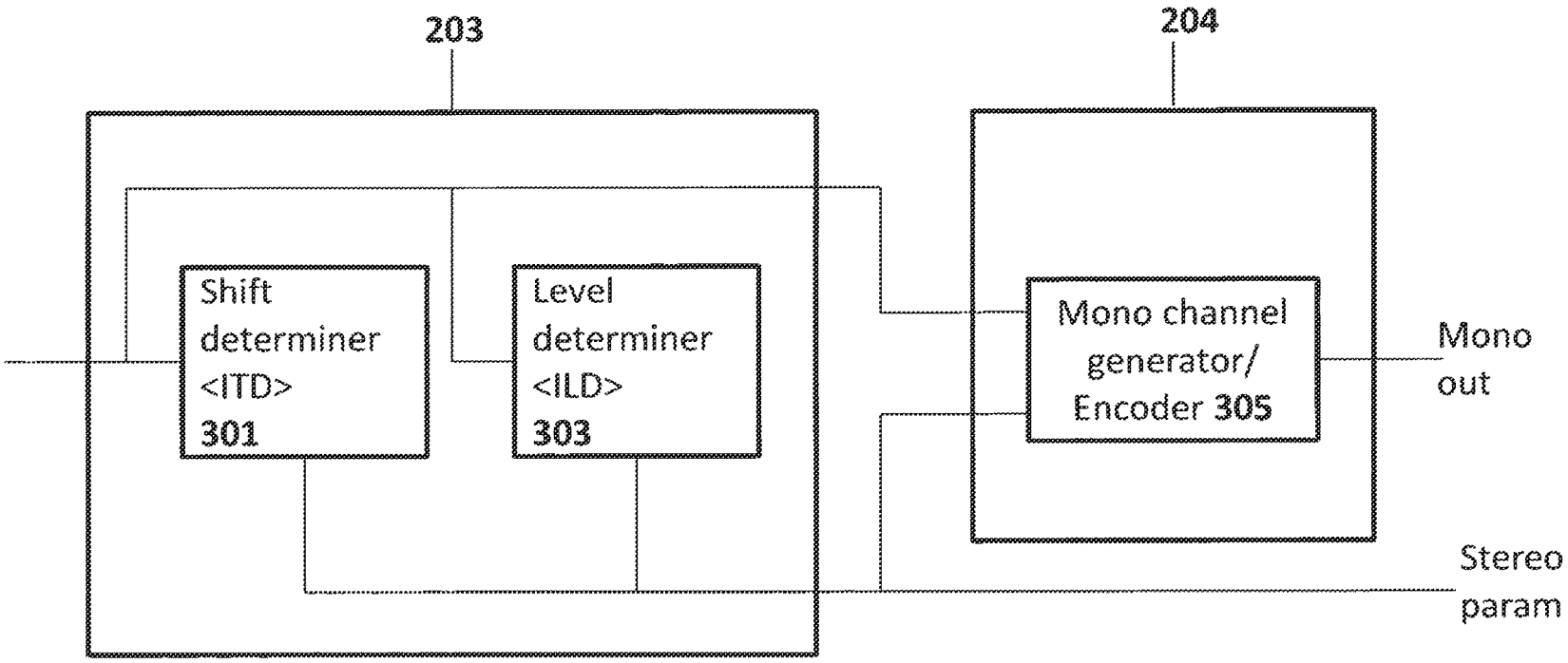
FIG. 4 shows schematically a channel analyser as shown in FIG. 3 in further detail according to some embodiments.
Figure 5:
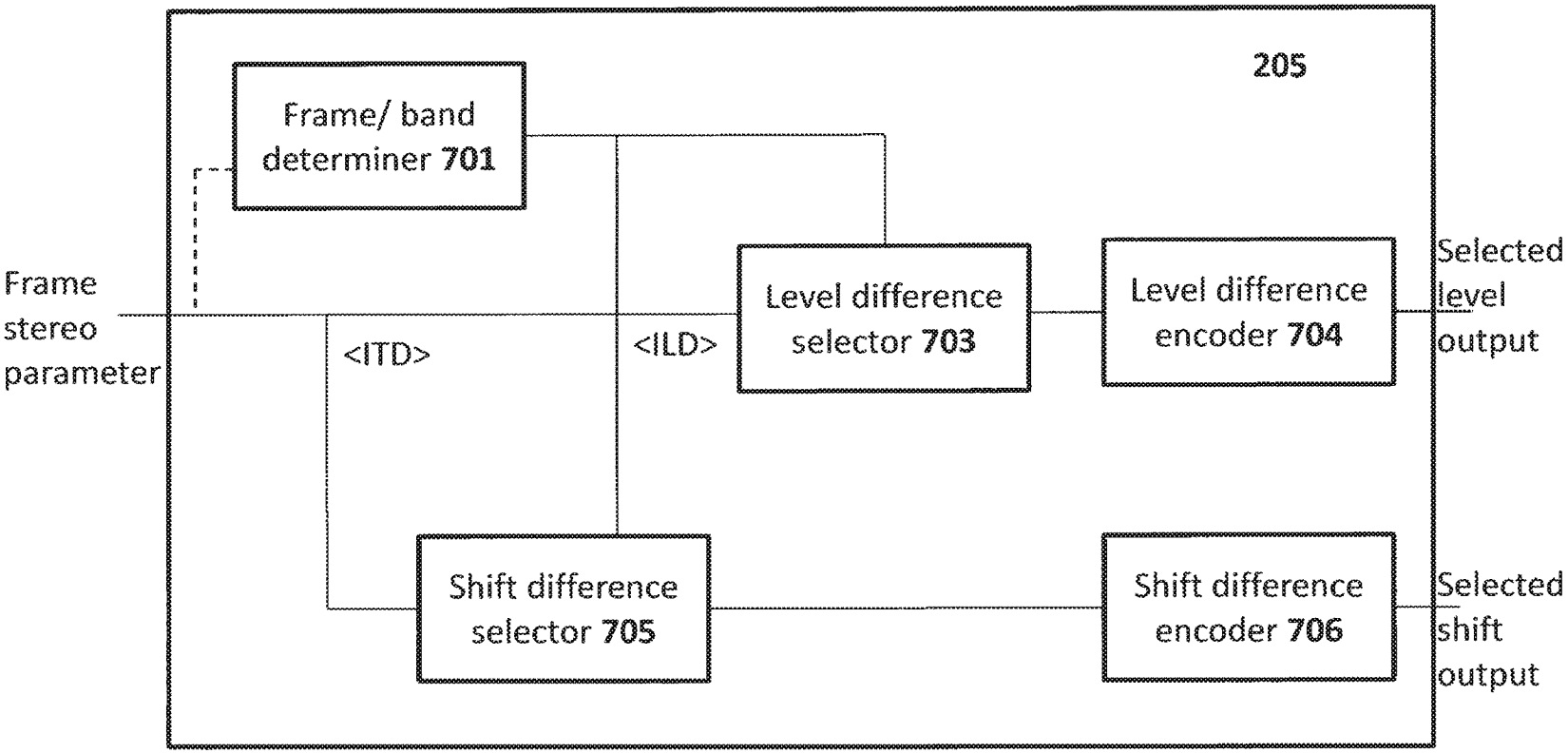
FIG. 5 shows schematically a stereo parameter encoder as shown in FIG. 3 in further detail according to some embodiments.
Figure 6:
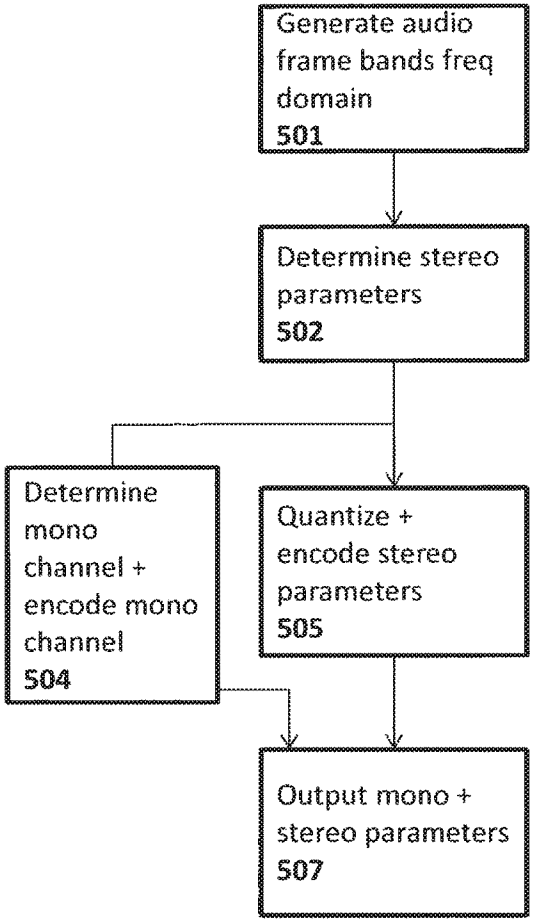
FIG. 6 shows a flow diagram illustrating the operation of the encoder shown in FIG. 3 according to some embodiments.
Figure 7:
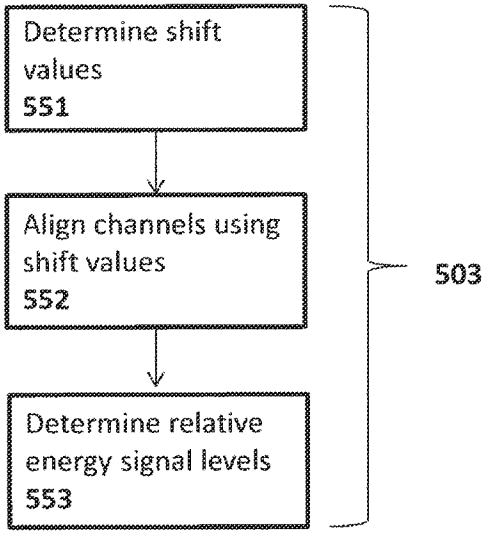
FIG. 7 shows a flow diagram illustrating the operation of the channel analyser as shown in FIG. 4 according to some embodiments.

It would be appreciated that the schematic structures described in FIGS. 3 to 5, and 9, and the method steps shown in FIGS. 6 to 7 and 10 represent only a part of the operation of an audio codec and specifically part of a stereo encoder/decoder apparatus or method as exemplarily shown implemented in the apparatus shown in FIG. 1.

Figure 2:
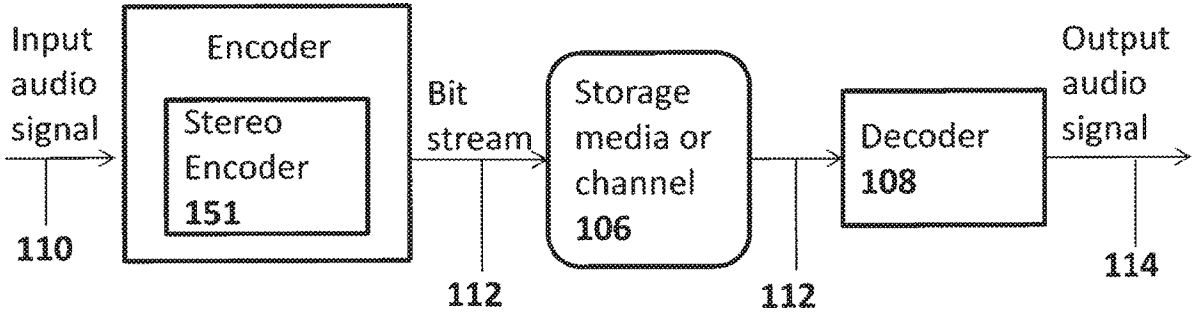
FIG. 2 shows schematically an audio codec system according to some embodiments.

The general operation of audio codecs as employed by embodiments is shown in FIG. 2. General audio coding/decoding systems comprise both an encoder and a decoder, as illustrated schematically in FIG. 2. However, it would be understood that some embodiments can implement one of either the encoder or decoder, or both the encoder and decoder. Illustrated by FIG. 2 is a system 102 with an encoder 104 and in particular a stereo encoder 151, a storage or media channel 106 and a decoder 108. It would be understood that as described above some embodiments can comprise or implement one of the encoder 104 or decoder 108 or both the encoder 104 and decoder 108.

The encoder 104 compresses an input audio signal 110 producing a bit stream 112, which in some embodiments can be stored or transmitted through a media channel 106. The encoder 104 furthermore can comprise a stereo encoder 151 as part of the overall encoding operation. It is to be understood that the stereo encoder may be part of the overall encoder 104 or a separate encoding module. The encoder 104 can also comprise a multi-channel encoder that encodes more than two audio signals.

The bit stream 112 can be received within the decoder 108. The decoder 108 decompresses the bit stream 112 and produces an output audio signal 114. The decoder 108 can comprise a stereo decoder as part of the overall decoding operation. It is to be understood that the stereo decoder may be part of the overall decoder 108 or a separate decoding module. The decoder 108 can also comprise a multi-channel decoder that decodes more than two audio signals. The bit rate of the bit stream 112 and the quality of the output audio signal 114 in relation to the input signal 110 are the main features which define the performance of the coding system 102.

Figure 3:
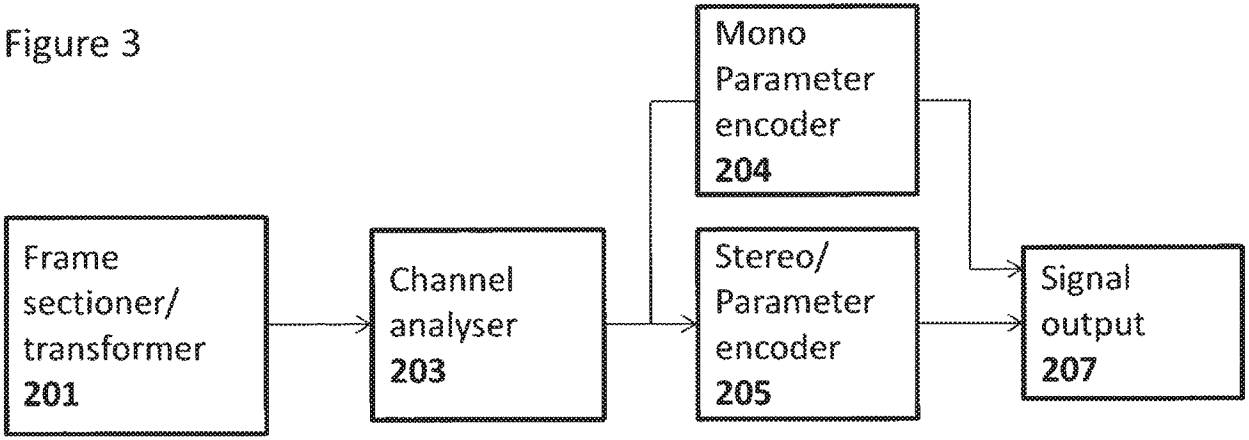
FIG. 3 shows schematically an encoder as shown in FIG. 2 according to some embodiments.

FIG. 3 shows schematically the encoder 104 according to some embodiments. FIG. 6 shows schematically in a flow diagram the operation of the encoder 104 according to some embodiments. In the examples provided herein the input audio signal is a two channel or stereo audio signal, which is analysed and a mono parameter representation is generated from a mono parameter encoder and stereo encoded parameters are generated from a stereo parameter encoder. However it would be understood that in some embodiments the input can be any number of channels which are analysed and a downmix parameter encoder generates a downmixed parameter representation and a channel extension parameter encoder generate extension channel parameters.

The concept for the embodiments as described herein is thus to determine and apply a multichannel (stereo) coding mode to produce efficient high quality and low bit rate real life multichannel (stereo) signal coding. To that respect with respect to FIG. 3 an example encoder 104 is shown according to some embodiments. Furthermore with respect to FIG. 6 the operation of the encoder 104 is shown in further detail.

The encoder 104 in some embodiments comprises a frame sectioner/transformer 201. The frame sectioner/transformer 201 is configured to receive the left and right (or more generally any multi-channel audio representation) input audio signals and generate frequency domain representations of these audio signals to be analysed and encoded. These frequency domain representations can be passed to the channel analyser 203.

In some embodiments the frame sectioner/transformer can be configured to section or segment the audio signal data into sections or frames suitable for frequency domain transformation. The frame sectioner/transformer 201 in some embodiments can further be configured to window these frames or sections of audio signal data according to any suitable windowing function. For example the frame sectioner/transformer 201 can be configured to generate frames of 20 ms which overlap preceding and succeeding frames by 10 ms each.

In some embodiments the frame sectioner/transformer can be configured to perform any suitable time to frequency domain transformation on the audio signal data. For example the time to frequency domain transformation can be a discrete Fourier transform (DFT), Fast Fourier transform (FFT), modified discrete cosine transform (MDCT). In the following examples a Fast Fourier Transform (FFT) is used. Furthermore the output of the time to frequency domain transformer can be further processed to generate separate frequency band domain representations (sub-band representations) of each input channel audio signal data. These bands can be arranged in any suitable manner. For example these bands can be linearly spaced, or be perceptual or psychoacoustically allocated.

The operation of generating audio frame band frequency domain representations is shown in FIG. 6 by step 501.

In some embodiments the frequency domain representations are passed to a channel analyser 203.

In some embodiments the encoder 104 can comprise a channel analyser 203 or means for analysing at least one audio signal. The channel analyser 203 can be configured to receive the sub-band filtered representations of the multi-channel or stereo input. The channel analyser 203 can furthermore in some embodiments be configured to analyse the frequency domain audio signals and determine parameters associated with each sub-band with respect to the stereo or multi-channel audio signal differences.

The generated mono (or downmix) signal or mono (or downmix) parameters can in some embodiments be passed to the mono parameter encoder 204.

The stereo parameters (or more generally the multi-channel parameters) can be output to the stereo parameter encoder 205.

In the examples described herein the mono (or downmix) and stereo (or channel extension or multi-channel) parameters are defined with respect to frequency domain parameters, however time domain or other domain parameters can in some embodiments be generated.

The operation of determining the stereo (or channel extension or multi-channel) parameters is shown in FIG. 6 by step 503.

With respect to FIG. 4 an example channel analyser 203 according to some embodiments is described in further detail. Furthermore with respect to FIG. 7 the operation of the channel analyser 203 as shown in FIG. 4 is shown according to some embodiments.

In some embodiments the channel analyser/mono encoder 203 comprises a shift determiner 301 or means for determining a shift between at least two audio signals. The shift determiner 301 is configured to select the shift for a sub-band such that it maximizes the real part of the correlation between the signal and the shifted signal, in the frequency domain. The shifts (or the best correlation indices COR_IND[j]) can be determined for example using the following code.

```
for ( j = 0; NUM_OF_BANDS_FOR_COR_SEARCH; j++ )
{
  cor = COR_INIT;
  for ( n = 0; n < 2*MAXSHIFT + 1; n++ )
  {
    mag[n] = 0.0f;
    for ( k = COR_BAND_START[j]; k < COR_BAND_START[j+1];
    k++ )
    {
      mag[n] += svec_re[k] * cos( -2*PI*((n-MAXSHIFT) *
      k / L_FFT );
      mag[n] -= svec_im[k] * sin( -2*PI*((n-MAXSHIFT) *
      k / L_FFT );
    }
    if (mag[n] > cor)
    {
      cor_ind[j] = n - MAXSHIFT;
      cor = mag[n];
    }
  }
}
```

Where the value MAXSHIFT is the largest allowed shift (the value can be based on a model of the supported microphone arrangements or more simply the distance between the microphones) PI is π, COR_INIT is the initial correlation value or a large negative value to initialise the correlation calculation, and COR_BAND_START [ ] defines the starting points of the sub-bands. The vectors svec_re [ ] and svec_im [ ], the real and imaginary values for the vector, used herein are defined as follows:

```
svec_re[0] = fft_l[0]* fft_r[0];
svec_im[0] = 0.0f;
for (k = 1; k <
COR_BAND_START[NUM_OF_BANDS_FOR_COR_SEARCH]; k++)
{
  svec_re[k] = (fft_l[k] * fft_r[k])-(fft_l[L_FFT-k] *
  (-fft_r[L_FFT-k]));
  svec_im[k] = (fft_l[L_FFT-k] * fft_r[k]) + (fft_l[k] *
  (-fft_r[L_FFT-k]));
}
```

The operation of determining the correlation values is shown in FIG. 7 by step 553.

The correlation values can in some embodiments be passed to the mono channel encoder 204 and as stereo channel parameters to the stereo parameter encoder 205 and in some embodiments the shift difference selector 705.

Furthermore in some embodiments the shift value is applied to one of the audio channels to provide a temporal alignment between the channels. These aligned channel audio signals can in some embodiments be passed to a relative energy signal level determiner 303.

The operation of aligning the channels using the determined shift value is shown in FIG. 7 by step 552.

In some embodiments the channel analyser/encoder 203 comprises a relative energy signal level determiner 303 or means for determining a relative level difference between at least two audio signals. The relative energy signal level determiner 303 is configured to receive the output aligned frequency domain representations and determine the relative signal levels between pairs of channels for each sub-band. It would be understood that in the following examples a single pair of channels are analysed by a suitable stereo channel analyser and processed however it would be understood that in some embodiments this operation can be extended to any number of channels (in other words a multi-channel analyser or suitable means for analysing multiple or two or more channels to determine parameters defining the channels or differences between the channels. This can be achieved for example by a suitable pairing of the multichannels to produce pairs of channels which can be analysed as described herein.

In some embodiments the relative level for each band can be computed using the following code.

```
For (j = 0; j < NUM_OF_BANDS_FOR_SIGNAL_LEVELS; j++)
  {
    mag_l = 0.0;
    mag_r = 0.0;
    for (k = BAND_START[j]; k < BAND_START[j+1]; k++)
    {
      mag_l += fft_l[k]*fft_l[k] + fft_l[L_FFT-k]*fft_l[L_FFT-k];
      mag_r += fft_r[k]*fft_r[k] + fft_r[L_FFT-k]*fft_r[L_FFT-k];
    }
    mag[j] = 10.0f*log10(sqrt((mag_l+EPSILON)/(mag_r+
    EPSILON)));
  }
```

Where L_FFT is the length of the FFT and EPSILON is a small value above zero to prevent division by zero problems. The relative energy signal level determiner in such embodiments effectively generates magnitude determinations for each channel (for example in a stereo channel configuration the left channel L and the right channel R) over each sub-band and then divides one channel value by the other to generate a relative value. In some embodiments the relative energy signal level determiner 303 is configured to output the relative energy signal level to the mono (or downmix) parameter encoder 204 and the stereo (or multi-channel or channel extension) parameter encoder 205 and in some embodiments the level difference selector 703.

The operation of determining the relative energy signal level is shown in FIG. 7 by step 553.

In some embodiments any suitable inter level (energy) and inter temporal (shift or delay) difference estimation can be performed. For example for each frame there can be two windows for which the shift (delay) and levels are estimated. Thus for example where each frame is 10 ms there may be two windows which may overlap and are delayed from each other by 5 ms. In other words for each frame there can be determined two separate delay and level difference values which can be passed to the encoder for encoding.

Furthermore in some embodiments for each window the differences can estimated for each of the relevant sub bands. The division of sub-bands can in some embodiments be determined according to any suitable method.

For example the sub-band division in some embodiments which then determines the number of inter level (energy) and inter temporal (shift or delay) difference estimation can be performed according to a selected bandwidth determination. For example the generation of audio signals can be based on whether the output signal is considered to be wideband (WB), superwideband (SWB), or fullband (FB) (where the bandwidth requirement increases in order from wideband to fullband). For the possible bandwidth selections there can in some embodiments be a particular division in subbands. Thus for example the sub-band division for the FFT domain for temporal or delay difference estimates can be:

ITD sub-bands for Wideband (WB)
const short scale1024_WB[ ]={1, 5, 8, 12, 20, 34, 48, 56, 120, 512};
ITD sub-bands for Superwideband (SWB)
const short scale1024_SWB[ ]={1, 2, 4, 6, 10, 14, 17, 24, 28, 60, 256, 512};
ITD sub-bands for Fullband (FB)
const short scale1024_FB[ ]={1, 2, 3, 4, 7, 11, 16, 19, 40, 171, 341, 448/* ~21 kHz*/};
ILD sub-bands for Wideband (WB)
const short scf_band_WB[ ]={1, 8, 20, 32, 44, 60, 90, 110, 170, 216, 290, 394, 512};
ILD sub-bands for Superwideband (SWB)
const short scf_band_SWB[ ]={1, 4, 10, 16, 22, 30, 45, 65, 85, 108, 145, 197, 256, 322, 412, 512};
ILD sub-bands for Fullband (FB)
const short scf_band_FB[ ]={1, 3, 7, 11, 15, 20, 30, 43, 57, 72, 97, 131, 171, 215, 275, 341, 391, 448/* ~21 kHz*/};

In other words in some embodiments there can be different sub-bands for delays and levels differences.

As shown in FIG. 4 the encoder can further comprise a mono parameter encoder 204 (or more generally the downmix parameter encoder or means for encoding at least one downmix parameter). The operation of the example mono (downmix) parameter encoder 204 is shown in FIG. 8.

In some embodiments the apparatus comprises a mono (or downmix) parameter encoder 204. The mono (or downmix) parameter encoder 204 in some embodiments comprises a mono (or downmix) channel generator/encoder 305 configured to receive the channel analyser values such as the relative energy signal level from the relative energy signal level determiner 303 and the shift level from the shift determiner 301. Furthermore in some embodiments the mono (downmix) channel generator/encoder 305 can be configured to further receive the input stereo (multichannel) audio signals. The mono (downmix) channel generator/encoder 305 can in some embodiments be configured to apply the shift (delay) and level differences to the stereo (multichannel) audio signals to generate an 'aligned' mono (or downmix) channel which is representative of the audio signals. In other words the mono (downmix) channel generator/encoder 305 can generate a mono (downmix) channel signal which represents an aligned stereo (multichannel) audio signal. For example in some embodiments where there is determined to be a left channel audio signal and a right channel audio signal one of the left or right channel audio signals are delayed with respect to the other according to the determined delay difference and then the delayed channel and other channel audio signals are averaged to generate a mono channel signal. However it would be understood that in some embodiments any suitable mono channel generating method can be implemented. It would be understood that in some embodiments the mono channel generator or suitable means for generating audio channels can be replaced by or assisted by a 'reduced' (or downmix) channel number generator configured to generate a smaller number of output audio channels than input audio channels. Thus for example in some multichannel audio signal examples where the number of input audio signal channels is greater than two the 'mono channel generator' is configured to generate more than one channel audio signal but fewer than the number of input channels.

The operation of generating a mono channel signal (or reduced number of channels) from a multichannel signal is shown in FIG. 8 by step 555.

The mono (downmix) channel generator/encoder 305 can then in some embodiments encode the generated mono (downmix) channel audio signal (or reduced number of channels) using any suitable encoding format. For example in some embodiments the mono (downmix) channel audio signal can be encoded using an Enhanced Voice Service (EVS) mono (or multiple mono) channel encoded form, which may contain a bit stream interoperable version of the Adaptive Multi-Rate-Wide Band (AMR-WB) codec.

The operation of encoding the mono channel (or reduced number of channels) is shown in FIG. 8 by step 557.

The encoded mono (downmix) channel signal can then be output. In some embodiments the encoded mono (downmix) channel signal is output to a multiplexer to be combined with the output of the stereo parameter encoder 205 to form a single stream or output. In some embodiments the encoded mono (downmix) channel signal is output separately from the stereo parameter encoder 205.

The operation of determining a mono (downmix) channel signal and encoding the mono (downmix) channel signal is shown in FIG. 6 by step 504.

In some embodiments the encoder 104 comprises a stereo (or extension or multi-channel) parameter encoder 205 or means for encoding an extension parameter. In the following example the multi-channel parameter encoder is a stereo parameter encoder 205 or suitable means for encoding the multi-channel parameters. The stereo parameter encoder 205 can be configured to receive the multi-channel parameters such as the stereo (difference) parameters determined by the channel analyser 203. The stereo parameter encoder 205 can then in some embodiments be configured to perform a quantization on the parameters and furthermore encode the parameters so that they can be output (either to be stored on the apparatus or passed to a further apparatus).

The operation of quantizing and encoding the quantized stereo parameters is shown in FIG. 6 by step 505.

With respect to FIG. 5 an example stereo (multi-channel) parameter encoder 205 is shown in further detail. Furthermore with respect to FIG. 9 the operation of the stereo (multi-channel) parameter encoder 205 according to some embodiments is shown.

In some embodiments the stereo (multi-channel) parameter encoder 205 is configured to receive the stereo (multi-channel) parameters in the form of the channel level differences (ILD) and the channel delay differences (ITD).

The stereo (multi-channel) parameters can in some embodiments be passed to a level difference selector 703, for the ILD values, and a shift difference selector 705 for the ITD values.

The operation of receiving the stereo (multi-channel) parameters is shown in FIG. 9 by step 401.

In some embodiments the stereo parameters are further forwarded to a frame/band determiner 701.

In some embodiments the stereo (multi-channel) parameter encoder 205 comprises a frame/band determiner 701 or means for determining a value associated with the frame. The frame/band determiner 701 is configured to determine a frame counter value or frame value reference associated with the stereo (or multi-channel or extension channel) parameters. In some embodiments this can be determined by a counter incrementing on receiving a new frame set of stereo parameters. In some embodiments the frame value is a hashed version of the frame number within the audio stream.

The operation of determining the frame value is shown in FIG. 9 by step 403.

In some embodiments the frame/band determiner 701 can further be configured to generate a parameter selection criteria (or means for determining a selection criteria) based on the frame value. The parameter selection criterion is configured to determine which of the determined subband stereo (multi-channel) parameters are to be selected for a frame. The selection criteria can be any suitable criteria.

For example in some embodiments the sub-bands and their associated stereo (multi-channel) parameters are selected according to a cyclical sequential selection algorithm. In other words where there are sub-bands from 1 to 15 then for a particular frame (i) a first number of sub-bands are selected (for example the first six sub-band stereo (multi-channel) parameters 1, 2, 3, 4, 5 and 6). Then for a subsequent frame (i+1) the selection of parameters start with the next unselected sub-band and continues selecting a number of sub-band are selected (for this example another six sub-bands 7, 8, 9, 10, 11, and 12), and for the following frame (i+2) the sub bands starting from frame 13 onwards until the last sub-band is selected and then the selection restarts with the first subband again (in other words for another six sub-bands then the selections are 13, 14, 15, 1, 2, and 3).

In some embodiments the frame/band determiner 701 is configured to generate a parameter selection criteria or pattern which is not sequential (for example subsequent frames may select interleaving sub-bands) or non-linearly spaced sub-band selections and can be selected according to any suitable regular or pseudo-random selection criteria. For example the frame/band determiner 701 can determine which sub-bands are to be encoded using any suitable mapping between the frame number and the number of sub-bands.

Furthermore in some embodiments it would be understood that the number of selected sub-bands can differ from frame to frame. For example the frame/band determiner 701 can be configured to select a number of sub-bands based on the available bandwidth for transmitting the parameters.

In some embodiments the frame/band determiner 701 can be configured to output similar or the same determined sub-band selections to the shift difference selector 705 and to the level different selector 703. However it would be appreciated that in some embodiments the frame/band determiner 701 applies different selection criteria to the level difference values than the shift difference values. In some embodiments the frame/band determiner 701 can be configured to determine or apply a limited selection criteria to the level difference parameter values and select ail of the sub-bands for the shift difference parameter values or vice versa. Furthermore in some embodiments the difference between determined selections of level difference parameter values and shift difference parameter values can be dependent on the available bandwidth for the parameter encodings and for the level difference parameter values and the shift difference parameter values.

The operation of generating a parameter selection criteria based on the frame value (and in some embodiments variable bit rate) is shown in FIG. 9 by step 405.

The frame/band determiner 701 can then output the selection criteria (in other words the sub bands to be selected) to the shift difference selector 705 and the level difference selector 703.

In some embodiments the stereo (multi-channel) parameter encoder 205 comprises a level difference selector 703 (or means for selecting level difference parameters). The level difference selector 703 is configured to receive the inter-level differences (ILD) frame stereo (multi-channel) parameters and furthermore to receive the sub-band selections from the frame/band determiner 701. The level difference selector 703 is then configured to select or filter the ILD parameters for the indicated sub-bands. The selected level difference values can be passed to a level difference encoder 704.

Furthermore in some embodiments the stereo (multi-channel) parameter encoder 205 comprises a shift difference selector 705 (or means for selecting shift difference parameters). The shift difference selector 705 is configured to receive the inter-temporal difference (ITO) values of the frame stereo (multi-channel) parameters and the selection criteria values from the frame/band determiner 701. The shift difference selector 705 can then be configured to select the indicated sub-band difference parameter values and pass these values to a shift difference encoder 706.

The operation of selecting or filtering the difference parameters based on the selection criteria is shown in FIG. 9 by step 407.

In some embodiments the stereo (multi-channel) parameter encoder comprises a level difference encoder 704 (or means for encoding a level difference parameter). The level difference encoder 704 is configured to encode or quantize in a suitable manner the level difference parameters selected by the level difference selector 703 and output the selected level and values in an encoded form. In some embodiments these can be multiplexed with the mono (downmix) encoded signals or be passed separately to a decoder (or memory for storage). In some embodiments the difference values are vector quantized or encoded using 2 dimensional codebooks. However in some embodiments the level difference encoder can be configured to use index remapping based on a determined frequency of occurrence and Golomb-Rice encoding (or and other suitable entropy coding) the index value to reduce on average the number of bits required to encode each value.

Similarly the stereo (multi-channel) parameter encoder 205 in some embodiments comprises a shift difference encoder 706 (or means for encoding a shift difference parameter) configured to receive the selected shift difference parameters and encode the shift difference parameters in a suitable manner such as vector quantisation or other forms.

The operation of encoding or comprising the selected parameters is shown in FIG. 9 by step 409.

Furthermore the outputting of encoded selected parameters is shown in FIG. 9 by step 411.

Figure 11:
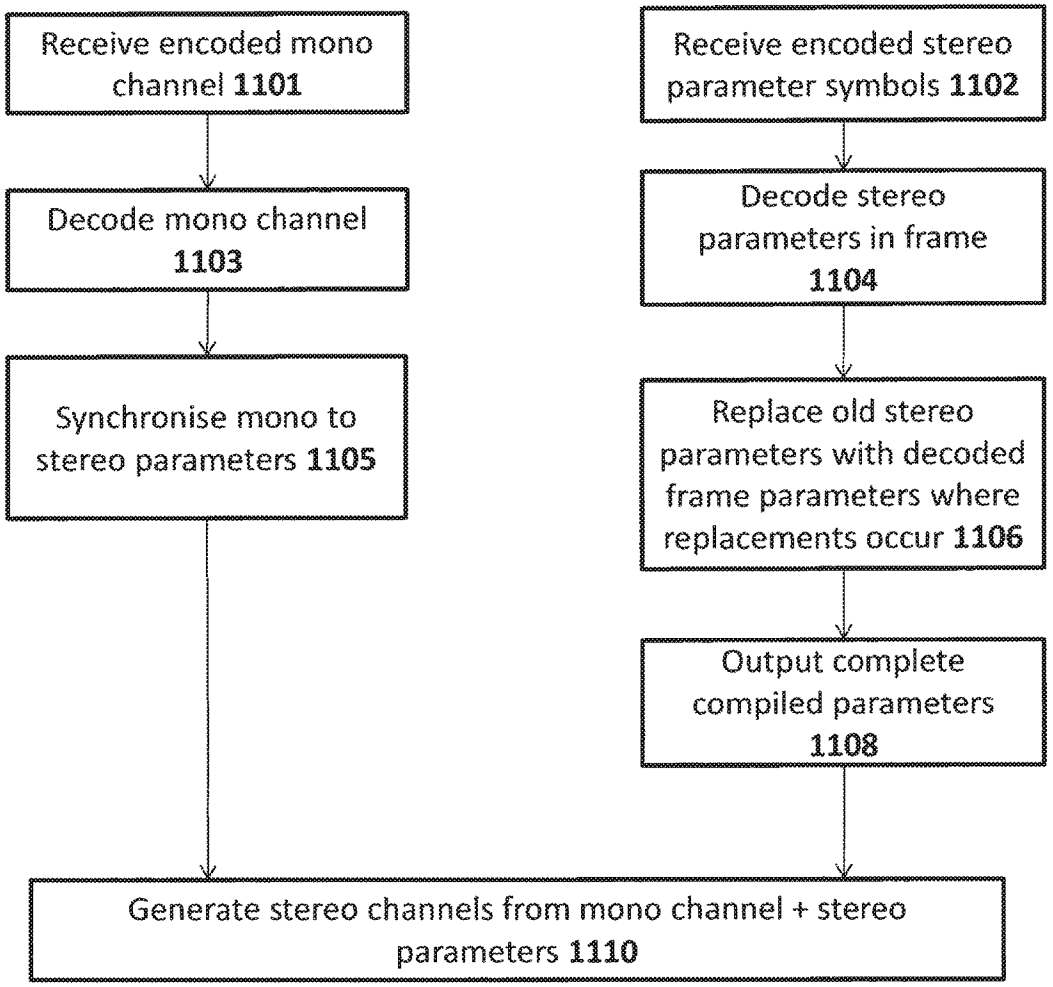
FIG. 11 shows a flow diagram illustrating the operation of the decoder as shown in FIG. 10 according to some embodiments.

In order to fully show the operations of the codec FIGS. 10 and 11 show a decoder and the operation of the decoder according to some embodiments. In the following example the decoder is a stereo decoder configured to receive a mono channel encoded audio signal and stereo channel extension or stereo parameters, however it would be understood that the decoder is a multichannel decoder configured to receive any number of channel encoded audio signals (downmix channels) and channel extension parameters.

In some embodiments the decoder 108 comprises a mono (downmix) channel decoder 1001 (or means for decoding a downmix channel). The mono (downmix) channel decoder 1001 is configured in some embodiments to receive the encoded mono (downmix) channel signal.

The operation of receiving the encoded mono (downmix) channel audio signal is shown in FIG. 11 by step 1101.

Furthermore the mono (downmix) channel decoder 1001 can be configured to decode the encoded mono (downmix) channel audio signal using the inverse process to the mono (downmix) channel encoder shown in the encoder.

The operation of decoding the mono (downmix) channel is shown in FIG. 11 by step 1103.

In some embodiments the decoder further is configured to output the decoded mono (downmix) signal to the stereo (multichannel) channel generator 1009 such that the decoded mono (downmix) signal is synchronised or received substantially at the same time as the decoded stereo (multichannel) parameters from the parameter set compiler 1005.

The operation of synchronising the mono to stereo parameters is shown in FIG. 10 by step 1105.

In some embodiments the decoder 108 can comprise a stereo (multi-channel) channel decoder 1003 (or means for decoding a multichannel or extension parameter). The stereo (multi-channel) channel decoder 1003 is configured to receive the encoded stereo (multi-channel) parameters.

The operation of receiving the encoded stereo (multi-channel) parameters is shown in FIG. 11 by step 1102.

Furthermore the stereo (multi-channel) channel decoder 1003 can be configured to decode the stereo (multi-channel) channel signal parameters by applying the inverse processes to that applied in the encoder. For example the stereo (multi-channel) channel decoder can be configured to output decoded stereo (multi-channel) parameters by applying the reverse of the shift difference encoder and level difference encoder.

The operation of decoding the stereo (multi-channel) parameters is shown in FIG. 11 by step 1104.

The stereo (multi-channel) channel decoder 1103 is further configured to output the decoded main stereo (multi-channel) parameters to a parameter set compiler 1005.

In some embodiments the decoder comprises a parameter set compiler 1005 (or means for compiling an extension parameter set). The parameter set compiler 1005 is configured to receive the decoded stereo (multi-channel) parameters and configured to replace any previous frame (or old) stereo (multi-channel) parameters with newly decoded frame parameters where replacement sub-band parameters are in the decoded frame.

The operation of replacing old stereo (multi-channel) parameters with decoded frame parameters where replacements occur is shown in FIG. 11 by step 1106.

The parameter set compiler 1005 thus contains a set of stereo (multi-channel) parameters containing all of the sub-band stereo parameters from the most recently received frames. These parameters can be passed to a stereo (multi-channel) channel generator 1009.

The outputting a 'complete' set of compiled parameters is shown in FIG. 11 by step 1108.

In some embodiments the parameter set compiler 1005 can be configured to have a replacement memory period or expiry period after which the parameter set compiler 1005 discards a stored stereo (multi-channel) parameter to prevent an obsolete stereo (multi-channel) parameter being sent to the stereo (multi-channel) channel generator 1009.

Figure 12:
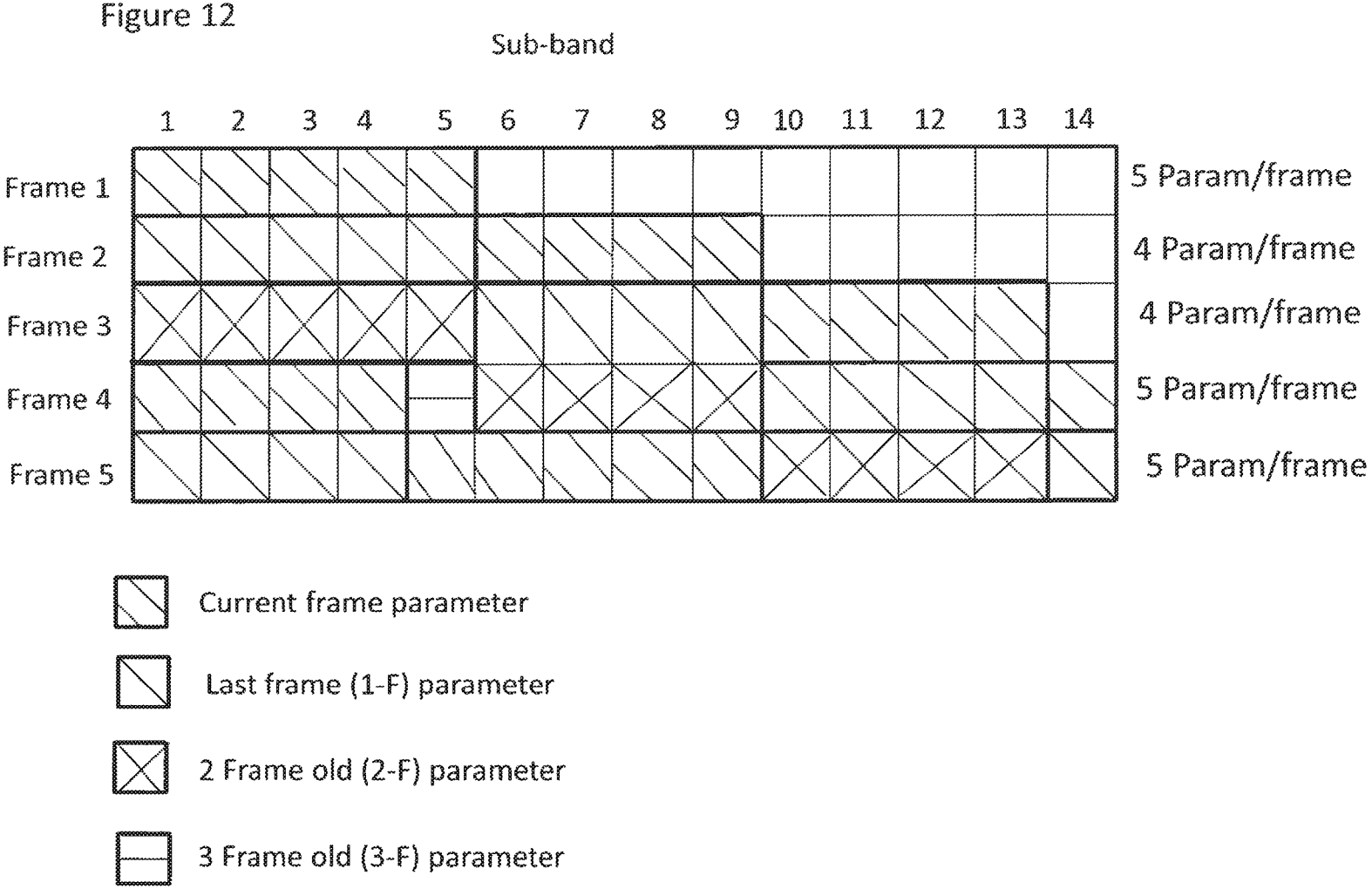
FIG. 12 shows an example frame by frame subband selection.

FIG. 12 shows schematically the way the coding of difference parameters enables a full set of difference parameters with varying levels of confidence in them as they get older (in other words the darker the values the more recent the values are).

Figure 13:
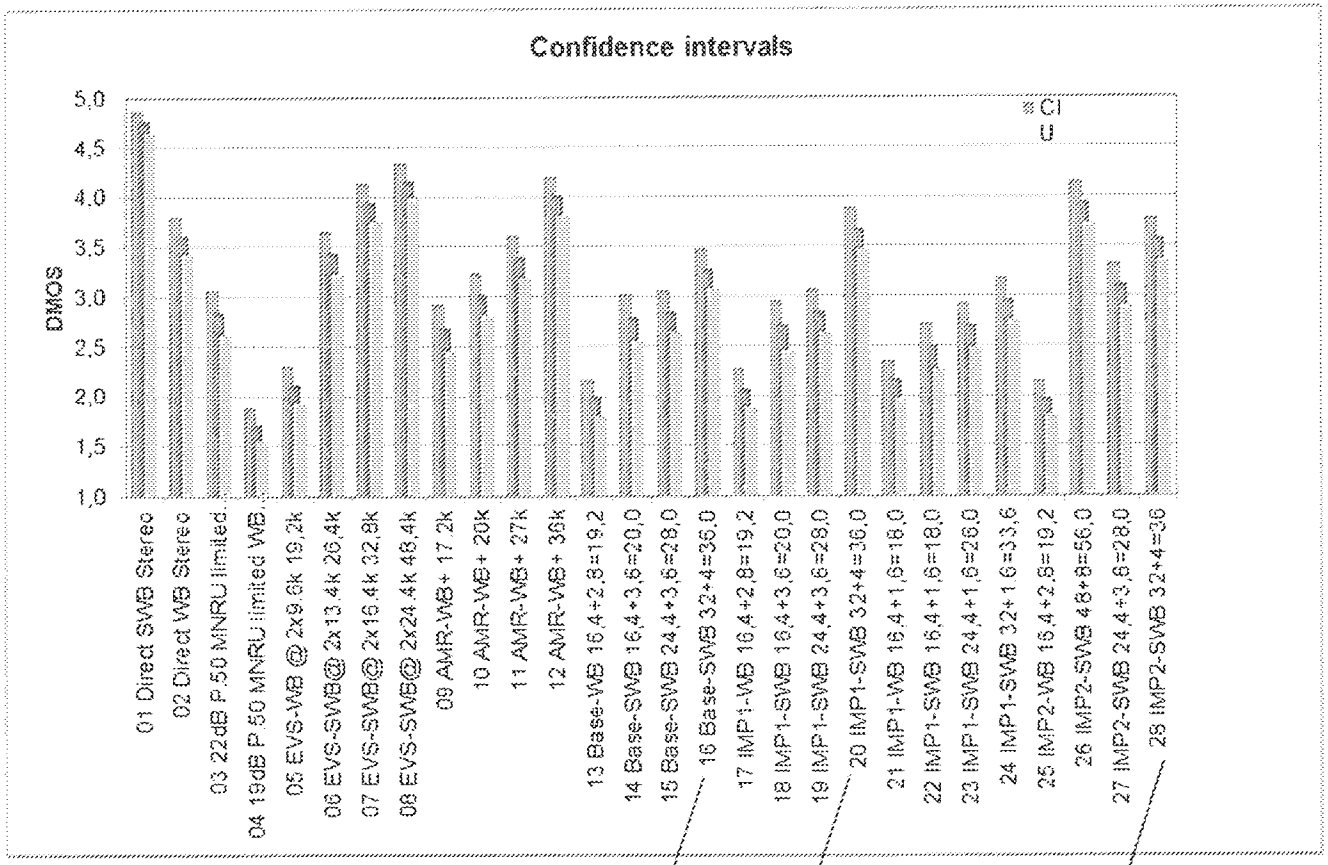
FIG. 13 shows the results of an example listening test for some embodiments.

FIG. 13 shows a graph of listening test results where conditions 16 and 20 can be compared, having the same bitrate for mono codec as well as for binaural extension. It can be observed that condition 20 (1103) that contains the proposed method perform better than the one not including it (condition 16 1101). Condition 28 (1105) is similar to condition 20 (1103) in terms of performance, the technical difference between them being that the delay values get relatively more bits, especially at lower binaural bitrates.

In some embodiments the decoder comprises a stereo channel generator 1009 (or means for generating an extension channel audio signal) configured to receive the decoded stereo (extension or multichannel) parameters and the decoded mono channel and regenerate the stereo channels in other words applying the level differences (extension parameters) to the mono (downmixed) channel to generate a second (or extended) channel.

The operation of generating the stereo (multi-channel) channels from the mono (downmixed) channel and stereo (extension) parameters is shown in FIG. 11 by step 1009.

Although the above examples describe embodiments of the application operating within a codec within an apparatus 10, it would be appreciated that the invention as described below may be implemented as part of any audio (or speech) codec, including any variable rate/adaptive rate audio (or speech) codec. Thus, for example, embodiments of the application may be implemented in an audio codec which may implement audio coding over fixed or wired communication paths.

Thus user equipment may comprise an audio codec such as those described in embodiments of the application above.

It shall be appreciated that the term user equipment is intended to cover any suitable type of wireless user equipment, such as mobile telephones, portable data processing devices or portable web browsers.

Furthermore elements of a public land mobile network (PLMN) may also comprise audio codecs as described above.

In general, the various embodiments of the application may be implemented in hardware or special purpose circuits, software, logic or any combination thereof. For example, some aspects may be implemented in hardware, while other aspects may be implemented in firmware or software which may be executed by a controller, microprocessor or other computing device, although the invention is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing devices, or some combination thereof.

The embodiments of this application may be implemented by computer software executable by a data processor of the mobile device, such as in the processor entity, or by hardware, or by a combination of software and hardware. Further in this regard it should be noted that any blocks of the logic flow as in the Figures may represent program steps, or interconnected logic circuits, blocks and functions, or a combination of program steps and logic circuits, blocks and functions.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the application may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this invention. However, various modifications and adaptations may become apparent to those skilled in the relevant ails in view of the foregoing description, when read in conjunction with the accompanying drawings and the appended claims. However, all such and similar modifications of the teachings of this invention will still fall within the scope of this invention as defined in the appended claims.

The invention claimed is:

1. An apparatus comprising at least one processor and at least one memory including computer program code for one or more programs, the at least one memory and the computer program code configured to, with the at least one processor, cause the apparatus at least to:

determine for a frame of at least one audio signal a set of frame audio signal multi-channel parameters of a number of sub-bands of the frame;

determine a coding bitrate for the frame of the at least one audio signal, wherein the coding bitrate varies between the frame of the at least one audio signal and a previous frame of the at least one audio signal;

select for the frame a sub-set of the set of frame audio signal multi-channel parameters at least in part based on a value associated with the frame and on the coding bitrate for the frame of the at least one audio signal by being caused to: determine the previous frame selected sub-set final element; determine a number of elements to be selected by selecting a number of sub bands based on the coding bitrate for the frame; and select the number of elements to be selected starting from an element succeeding the previous frame selected sub-set final element, wherein the previous frame has a different number of selected sub-bands to that of the frame based on the coding bitrate for the previous frame; and generate an encoded frame audio signal multi-channel parameter based on the selected sub-set of the set of frame audio signal multi-channel parameters.

2. The apparatus as claimed in claim 1, wherein the apparatus caused to determine for a frame of at least one audio signal a set of frame audio signal multi-channel parameters is caused to determine a set of differences between at least two channels of the at least one audio signal, wherein the set of differences comprises two or more difference values, where each difference value is associated with a sub-division of resources defining the frame.

3. The apparatus as claimed in claim 2, wherein the apparatus caused to determine a set of differences between at least two channels of the at least one audio signal is caused to perform at least one of:

determine at least one interaural time difference; and determine at least one interaural level difference.

4. The apparatus as claimed in claim 2, wherein the sub-division of resources defining the frame may comprise at least one of:

sub-band frequencies; and time periods.

5. The apparatus as claimed in claim 1, wherein the apparatus caused to generate an encoded frame audio signal multi-channel parameter based on the selected sub-set of the set of frame audio signal multi-channel parameters is caused to generate codebook indices for groups of the at least one frame audio signal multi-channel parameter using vector or scalar quantization codebooks.

6. The apparatus as claimed in claim 5, wherein the apparatus caused to generate codebook indices for groups of the at least one frame audio signal multi-channel parameter using vector or scalar quantization codebooks is caused to:

generate a first encoding mapping with an associated index for the at least one frame audio signal multi-channel parameter dependent on a frequency distribution of mapping instances of the at least one frame audio signal multi-channel parameter; and encode the first encoding mapping dependent on the associated index.

7. The apparatus as claimed in claim 6, wherein the apparatus caused to encode the first encoding mapping dependent on the associated index is caused to apply a Golomb-Rice encoding to the first encoding mapping dependent on the associated index.

8. A method comprising:

determining for a frame of at least one audio signal a set of frame audio signal multi-channel parameters of a number of sub-bands of the frame;

determining a coding bitrate for the frame of at the least one audio signal, wherein the coding bitrate varies between the frame of the at least one audio signal and a previous frame of the at least one audio signal;

selecting for the frame a sub-set of the set of frame audio signal multi-channel parameters based on a value associated with the frame and on the coding bitrate for the frame of the at least one audio signal by: determining the previous frame selected sub-set final element; determining a number of elements to be selected by selecting a number of sub bands based on the coding bitrate for the frame; and selecting the number of elements to be selected starting from an element succeeding the previous frame selected sub-set final element, wherein the previous frame has a different number of selected sub-bands to that of the frame based on the coding bitrate for the previous frame; and generating an encoded frame audio signal multi-channel parameter based on the selected sub-set of the set of frame audio signal multi-channel parameters.

9. The method as claimed in claim 8, wherein determining for a frame of at least one audio signal a set of frame audio signal multi-channel parameters comprises determining a set of differences between at least two channels of the at least one audio signal, wherein the set of differences comprises two or more difference values, where each difference value is associated with a sub-division of resources defining the frame.

10. The method as claimed in claim 9, wherein determining a set of differences between at least two channels of the at least one audio signal comprises determining at least one of:

at least one interaural time difference; and at least one interaural level difference.

11. The method as claimed in claim 9, wherein the sub-division of resources defining the frame comprises at least one of:

sub-band frequencies; and time periods.

12. The method as claimed in claim 8, wherein generating an encoded frame audio signal multi-channel parameter based on the selected sub-set of the set of frame audio signal multi-channel parameters comprises generating codebook indices for groups of the at least one frame audio signal multi-channel parameter using vector or scalar quantization codebooks.

13. The method as claimed in claim 12, wherein generating codebook indices for groups of the at least one frame audio signal multi-channel parameter using vector or scalar quantization codebooks comprises:

generating a first encoding mapping with an associated index for the at least one frame audio signal multi-channel parameter dependent on a frequency distribution of mapping instances of the at least one frame audio signal multi-channel parameter; and encoding the first encoding mapping dependent on the associated index.

14. The method as claimed in claim 13, wherein encoding the first encoding mapping dependent on the associated index comprises applying a Golomb-Rice encoding to the first encoding mapping dependent on the associated index.

* * * * *